US006098873A

United States Patent [19]

Sheffer

[11] Patent Number: 6,098,873

[45] Date of Patent: Aug. 8, 2000

[54] ONE PIECE FOLDED AND GLUED CONTAINER WITH TABBED COLUMNS

[75] Inventor: Phil B. Sheffer, Thomasville, Pa.

[73] Assignee: Pack 'N' Stack, Inc., Philadelphia, Pa.

[21] Appl. No.: 09/253,822

[22] Filed: Feb. 19, 1999

[51] Int. Cl.[7] ..... B65D 21/032

[52] U.S. Cl. ..... 229/178; 229/186; 229/915; 229/919

[58] Field of Search ..... 229/167, 178, 229/186, 915, 918, 919

[56] References Cited

U.S. PATENT DOCUMENTS

| | | | |
|---|---|---|---|
| D. 281,484 | 11/1985 | Dickes | D9/432 |
| D. 348,607 | 7/1994 | Young | D9/423 |
| 1,941,084 | 12/1933 | Gross . | |
| 2,122,885 | 7/1938 | Lowey . | |
| 2,214,813 | 9/1940 | Guyer . | |
| 2,233,874 | 3/1941 | Rosenthal . | |
| 2,637,483 | 5/1953 | Shapiro . | |
| 2,702,663 | 2/1955 | Klein . | |
| 2,965,279 | 12/1960 | Campbell | 229/915 |
| 3,102,674 | 9/1963 | Portola . | |
| 3,249,284 | 5/1966 | Wood . | |
| 3,251,529 | 5/1966 | Young . | |
| 3,258,191 | 6/1966 | Mueller et al. . | |
| 3,310,219 | 3/1967 | Dlugopolski | 229/178 |
| 3,545,665 | 12/1970 | Nimaroff . | |
| 4,101,048 | 7/1978 | Rieben et al. | 229/919 |
| 4,356,952 | 11/1982 | Rekow . | |
| 4,383,636 | 5/1983 | Chaffers . | |
| 4,899,929 | 2/1990 | Grollman | 229/122.1 |
| 5,249,550 | 10/1993 | Hines et al. | 191/168 |
| 5,277,360 | 1/1994 | DeMott | 229/122 |
| 5,330,094 | 7/1994 | Mertz | 229/167 |
| 5,505,371 | 4/1996 | O'Neill | 229/120.26 |
| 5,649,663 | 7/1997 | Pestow, Jr. | 229/915 |
| 5,839,650 | 11/1998 | Sheffer | 229/120.11 |

FOREIGN PATENT DOCUMENTS

| | | | |
|---|---|---|---|
| 2682355 | 4/1993 | France | 229/178 |
| 78006424 | 12/1979 | Netherlands | 229/919 |
| 946675 | 12/1994 | South Africa . | |
| 959296 | 3/1995 | South Africa . | |
| 1290267 | 9/1972 | United Kingdom | 229/178 |

*Primary Examiner*—Gary E. Elkins
*Attorney, Agent, or Firm*—Duane, Morris & Heckscher LLP

[57] ABSTRACT

A container is made in a collapsed configuration with bellows fold corners for self-erection and has spaced-panel end walls encompassing hollow columns for vertical reinforcement. An outer end wall panel is joined to the container bottom, leading to a ledge panel that is horizontal when the container is erected, and an inner end wall panel folds over and down to lock via tabs into openings in the bottom. The hollow columns reside under the ledge panel and are provided by column-forming panels folded inwardly and glued to the inner end wall panels. Score or fold lines define the corners of the hollow column and are placed to bear against inner sides of the front and back walls, which holds the hollow columns open when the container is erected. The column-forming panels have protruding tabs backed by corresponding tabs on a ledge panel between inner and outer panels of the end walls. These tabs form a two thickness registration tab that engages a corresponding opening in the container bottom for stacking. The registration tab is barb shaped, having laterally opposite stepped edges dimensioned such that edges of the top panel flaps pass and are locked down by the stepped edges when the top panel flaps are folded downwardly to engage the registration tab. The container can be made entirely automatically in a knocked-down-flat state by application of glue and folding at the appropriate lines, and is erected in a single motion.

21 Claims, 6 Drawing Sheets

ONE PIECE FOLDED AND GLUED CONTAINER WITH TABBED COLUMNS

BACKGROUND OF THE INVENTION

1. Field of the Invention

The invention relates to paperboard, corrugated or similar cartons and containers made from a one piece flat blank, having panels that are preliminarily folded and glued such that the container is manufactured in a knocked-down flat configuration, and is erected into a rectilinear box when loaded with product. According to the invention, the folded and glued panels of a one-piece erectable blank with self-erecting gusset corners, comprise container end walls with spaced inner and outer end wall panels and an upper ledge. The end wall panels and ledge encompass hollow erectable support columns associated with upwardly protruding stacking tabs. The stacking tabs are spaced inwardly from the container ends and serve to lock down opposite top or lid flaps after the container is loaded. The container is particularly apt for agricultural products and can be supplied in a stack of knocked-down container forms that are erected, loaded, closed and stacked with only a few quick movements.

At the corners of the container, self-erecting bellows or gusset joints are provided at which diagonally folded panels between the end and side walls are glued to an inner face of the outer end wall panels. When erected by folding the end wall panels upright relative to the bottom, the side walls and end walls pull one another into an upright rectilinear shape.

The end walls are vertically reinforced by the internal hollow columns, which are disposed under the ledge in the erected state of the container. Column-forming panels extend laterally from the inner end wall panel of the flat blank. These column-forming panels are preliminarily scored, folded laterally inwardly and are glued to the inner end wall panels exclusively at ends of the column-forming panels. The columns are opened at the folds and scores, from a flat parallelogram into a column with rectangular cross section, by lateral inward pressure. During erection of the container, the columns are manually pressed laterally inwardly as the end walls are folded longitudinally inwardly between the side walls. The erected side walls old the hollow columns open and the end walls wrap around the columns and lock into the bottom by tabs inserted into openings in the container bottom At least one stacking tab is defined to protrude from the inner end wall panel to which the column forming panels are glued. The inner end wall panel and the column-forming panels have corresponding tabs that are glued together in two thicknesses. Thus a two-thickness tab protrudes upwardly from the surface of the erected container for engagement in an opening in the underside of an overlying container of the same type.

Inasmuch as the stacking tabs are integral with the inner end wall panels and the column-forming panels, the stacking tabs can be spaced longitudinally inwardly from the outer end walls of the container. The tabs are cut with a barbed shape and function as locking clasps to hold the opposite top panels closed, when folded inwardly from front and rear side walls.

The container can be cut from flat stock,scored and formed into a knocked-down-flat state entirely by automated means, namely a fold-and-glue machine that applies glue and folds the panels s the blank is fed through the machine. The container is erected on site by simply folding in the end walls. When loaded, the container is closed and locked by pushing down the top flaps, and is stackable in registry with very good vertical stacking support.

2. Prior Art

Corrugated and paperboard containers are made from pieces that are cut in required shapes from sheet stock, and are assembled to form the walls of a full or partial enclosure. Variations are possible in which several integral parts are formed and then assembled using glue, tape, staples or the like. For example, the container body and lid may be separate parts, or various types of inserts may be used for reinforcement or other purposes such as subdividing the volume of the container into discrete areas. Containers are supplied in a collapsed state because storage or handling of empty containers is wasteful of space. The containers are partly formed, with their parts cut out and certain seams and folds provided. The packer erects the containers prior to loading, finishing any required assembly steps in the process, and finally closes the loaded containers for storage or shipment. For example, a container may be cut out from integral flat stock, folded and scored for the corners of the container (with least one seam), and supplied with the opposite side and end walls collapsed flat against one another. Top and bottom flaps are likewise integrally attached to the side and end walls at folds or score lines. The packer erects the container from a flat parallelogram into its rectilinear shape, folding the top or bottom flaps inwardly before and after loading, and finally closing the container at seams that are taped, glued or otherwise attached.

It is efficient to provide a form of container in which all the container parts are Integral extensions of a single piece of flat material. Separate parts such as discrete lids, partitions and reinforcing inserts involve manual assembly steps. Manual assembly steps consume worker time and are costly. In addition, assembly steps can be physically taxing and may lead to repetitive motion injuries. It is preferable if containers are substantially fully formed when supplied, and require the least possible manual action to deploy, load, close and store or pack the containers for shipment.

Self-erecting paperboard and corrugated containers are known with their respective wall panels and flaps connected in such a way that one or more of the structural parts of the container is pulled into an erected position as the other parts are erected. Commonly owned pending patent application Ser. No. 09/129,375, filed Aug. 5, 1998 and entitled Stackable Container—Sheffer discloses an integral blank container having bellows or gusset corners that couple a bottom panel with side and end wall panels to pull the respective panels into a rectilinear shape when the container is erected from a knocked-down-flat configuration by folding end wall panels perpendicular to the bottom panel. U.S. Pat. No. 4,899,929—Grollman likewise discloses self-erecting bottom flaps connected to container side walls by folded-back glued panels arranged to pull the bottom flaps downwardly when the side walls are erected by expanding the container from a flattened parallelogram.

The foregoing Sheffer application also discloses a locking tab structure in which a plural thickness tab protrudes upwardly from the structure of the container end wall to engage in an opening in a similar container stacked thereon. One objective of cartons or containers as described is to bear the load of products loaded into the containers, as well as to bear the load of additional containers that may be stacked on a given container For this purpose, the panels that are folded and glued can include wall panels having multiple thicknesses of glued-together material and/or partition walls that extend between opposite side walls or end walls. These structural reinforcing features add to the vertical stacking strength or load bearing capacity of the container, namely the maximum vertical weight that can be borne without buckling or displacing the container walls. A container should have good vertical stacking strength, but if possible such stacking strength should be achieved without unnecessarily adding weight to the container. It is also advantageous if stacking strength can be achieved by means of reinforcements that occupy very little of the space that would otherwise be available for carrying product. Thus, considerations of container strength are sometimes at odds with considerations of weight and volume.

Containers are routinely stacked vertically to make efficient use of space, and may be reinforced against vertical crushing by employing multiple thickness of material for wall panels or by forming columns, for example as in U.S. Pat. No. 5,330,094—Merz. Known structures that are reinforced in this manner are constructed using separate inserts or using a container structure that requires various manual operations in order to install or erect the reinforcing structure Two or more containers are stacked in vertical registry to be carried manually, to be stacked in a storage area or for shipping on a pallet or the like, in any number of adjacent columns or in a staggered overlapping arrangement resembling masonry. Stacking maximizes the density of storage, and often enables a group of containers to be handled conveniently as a unit using a fork truck or two wheel hand dolly.

Containers in stacks may be subjected to various vertical and lateral forces. Vertical compression force is applied by the weight of upper containers in a stack and the product they contain. This vertical force is borne by vertically extending structural elements in the underlying cartons. The structural elements that bear vertical forces on a carton or similar container normally occupy only a limited span of lateral width and/or depth. For example, the vertical forces on many cartons are borne exclusively by their vertical side and end walls If the stacked cartons remain in registry, then the weight of each upper container is coupled by the side and end walls of the upper container to corresponding side and end walls of an underlying container, because the side and/or end walls of the upper and lower containers are disposed directly over and under one another. When the containers are displaced from exact registry, vertical support may be lacking. It is possible to enlarge the lateral width and depth of the side or end walls of a container such that a ledge is defined on which an upper container will rest up to a certain amount of container misalignment in the stack. An example of a ledge structure is disclosed in the foregoing Sheffer application. Registry tabs are also provided in U.S. Pat. No. 5,839,650—Sheffer. However, it is difficult to arrange for a ledge in a manner that is consistent with the objectives of fold-and-glue cartons, for example, to provide a knocked-down flat pre-erection blank for shipping that can be erected with a minimum of manual actions, to conserve container volume of product, and to ensure adequate vertical stacking strength. It would be advantageous if these objectives could all be balanced to provide an optimal container.

The present invention, as in the Sheffer pending application, provides a site-erected container or carton that is entirely formed from an integral flat blank. The only assembly required is erection from a knocked-down-flat configuration by folding the end walls into position to lock into the bottom panel. In so doing, the end and side walls are simultaneously erected perpendicular to the bottom panel; the end walls are provided with registry tabs on a stacking ledge, and are reinforced by the internal columns. The container is supplied with substantially all its joints pre-attached and can be produced automatically using a fold-and-glue container production machine, for example as available from Bobst Group, Inc., 146 Harrison Avenue, Roseland, N.J. 07068 (affiliated with Bobst, S A, Lausanne, C H). At the loading site the user need only fold the end panels into place, fill the container and press down the top flaps to produce a stackable unit that is readily handled, stacked on a pallet or otherwise processed for storage or shipment.

SUMMARY OF THE INVENTION

It is an object of the invention to structure a fold-and-glue knocked-down flat container blank so as to improve the vertical stacking strength of the erected container while also decreasing the reliance on correct registry of the containers by manual action.

It is another object to provide hollow vertical reinforcing columns in the end or side walls of a container, which columns are erectable from a folded flat configuration during erection of the container.

It is an object to minimize the manual steps needed to erect the container as described, in particular to cause the end and side walls of the container to erect into a vertical position and the hollow vertical columns to open and deploy, simply by folding end wall flaps inwardly over the columns to lock on the inner bottom wall of the container.

It is a further object to deploy a protruding registry tab when folding the end wall flaps inwardly, to place the registry tab at a space from the outer end walls of the container, and to use the registry tab not only as a structure for engaging with the underside of a next higher container in a stack, but also as a barb against which the free edges of the sidewall flaps can be locked to for a lidded closure.

These and other objects are accomplished by a container made in a collapsed configuration with bellows fold corners for self-erection, having spaced-panel end walls encompassing hollow columns for vertical reinforcement. An outer end wall panel is joined to the container bottom, leading to a ledge panel that is horizontal when the container is erected, and an inner end wall panel folds over and down to lock via tabs into openings in the bottom. The hollow columns reside under the ledge panel and are provided by column-forming panels folded inwardly and glued to the inner end wall panels. Score or fold lines define the corners of the hollow column and are placed to bear against inner sides of the front and back walls, which holds the hollow columns open when the container is erected. The column-forming panels have protruding tabs backed by corresponding tabs on a ledge panel between inner and outer panels of the end walls. These tabs form a two thickness registration tab that engages a corresponding opening in the container bottom for stacking. The registration tab is barb shaped, having laterally opposite stepped edges dimensioned such that edges of the top panel flaps pass and are locked down by the stepped edges when the top panel flaps are folded downwardly to engage the registration tab. The container can be made entirely automatically in a knocked-down-flat state by application of glue and folding at the appropriate lines, and is erected in a single motion.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
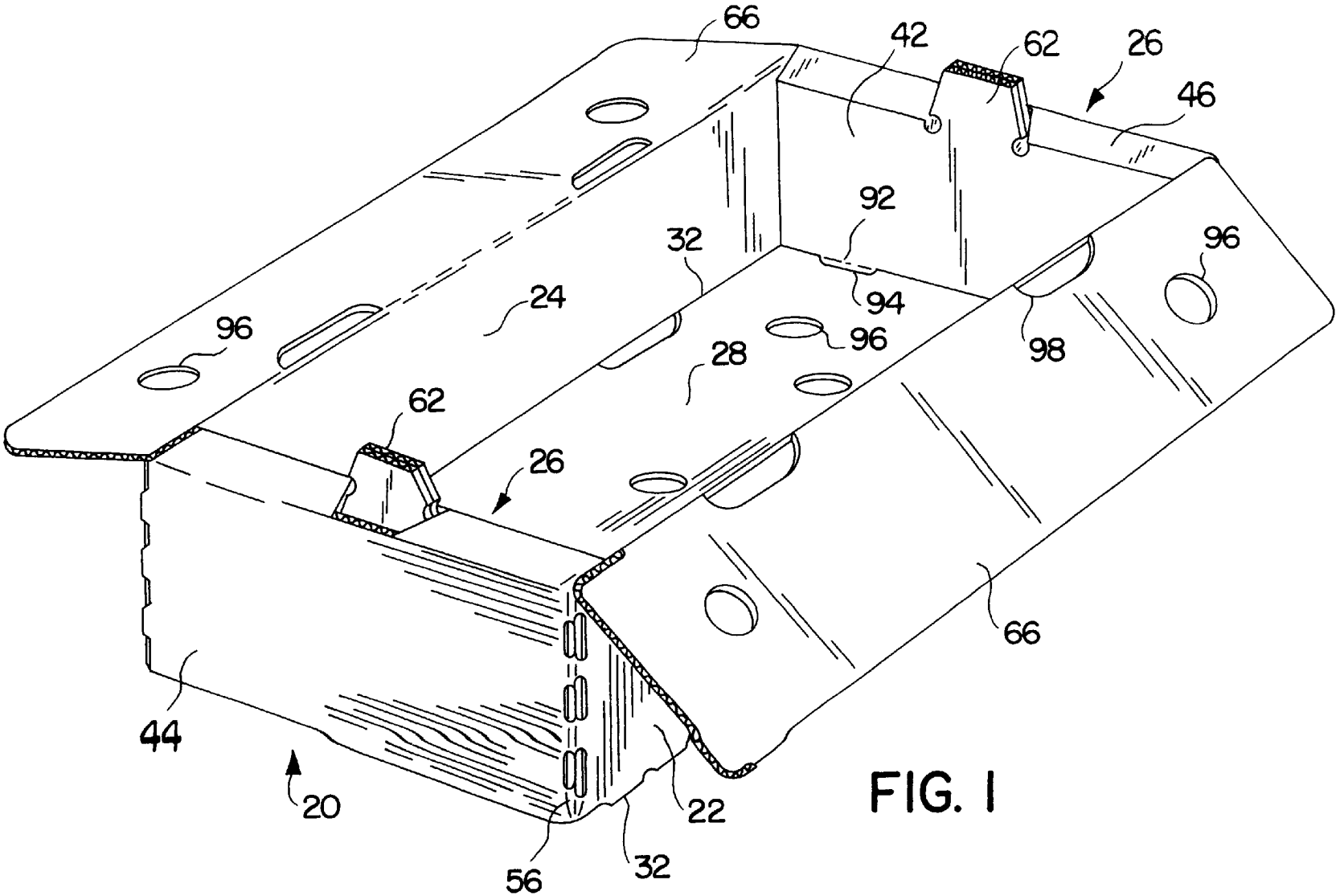
FIG. 1 is a perspective view of an erected container according to the invention, the top flaps shown folded open.

FIG. 1 shows a vertically reinforced stackable and self-erecting container 20 according to the invention, erected and ready for packing. Container 20 in the open state defines a rectilinear box shape with side and end walls including the front 22, back 24, and end walls 26, extending perpendicularly upwardly from a one piece container bottom 28, to which the walls 22, 24, 26 are connected at right angle fold lines 32. The front and back walls 22, 24 in the embodiment shown are of a single thickness of material The opposite end walls 26 each have a corresponding interior panel 42 and exterior panel 44, which are connected by and support a horizontal ledge panel 46. The panels forming container 20 are cut, folded and attached to one another, but all the panels are integral portions of a single flat blank 50, shown in FIG. 2, using corresponding reference numbers for the respective parts (as such numbers appear throughout the drawings).

As discussed in detail below, blank 50 is arranged by folding and gluing operations to provide a knocked-down-flat ("KDF") structure 52 (best shown in FIG. 6) that can be provided to a packer in a compact collapsed arrangement and has structures that engage one another when the container is erected. These structures provide vertical reinforcement for the end walls 26 via hollow columns 55 confined between the inner and outer end wall panels 42, 44 and in part by the inner face of the front or back 22, 24 of container 20. Bellows fold corner structures 56 cause the front, rear and end walls to pull one another into an orientation perpendicular to bottom 28 during erection of container 20. Registration tabs 62 and corresponding registration openings 64 provided in the area of ledge panel 46 and in the bottom 28 of container 20 permit the containers to be stacked in registry as keyed by the registration tabs 62.

The combination of an interior panel 42 and exterior panel 44 for each of the end walls 26 provides vertical strength to the container and resistance to lateral deformation. This is in part because the end walls 26 comprise multiple thicknesses of material and in part because the spaced end wall panels 42, 44 and the ledge panel 46 fit between the front and back panels 22, 24 and maintain the perpendicular relative orientation of the front and rear walls versus the end walls. According to an inventive aspect, the end walls also provide additional support, vertical strength and resistance to deformation due to hollow columns 55, which are erected upon erection of the container to reside between inner end wall panel 42 and outer end wall panel 42, beneath the ledge panel 46 and bearing against the inner surfaces of front and rear panels 22, 24. The ledges 46 with their underlying support also provide a pair of lateral areas that function as stable platforms that can support a container stacked on the container as shown, even if the upper container is out of registry with the lower one by part of the thickness of the ledge panel. In the preferred embodiment shown, registration tabs 62 associated with the end wall panels 42, 44 and the reinforcing hollow columns 55 keep the containers in registry when stacked.

Figure 2:
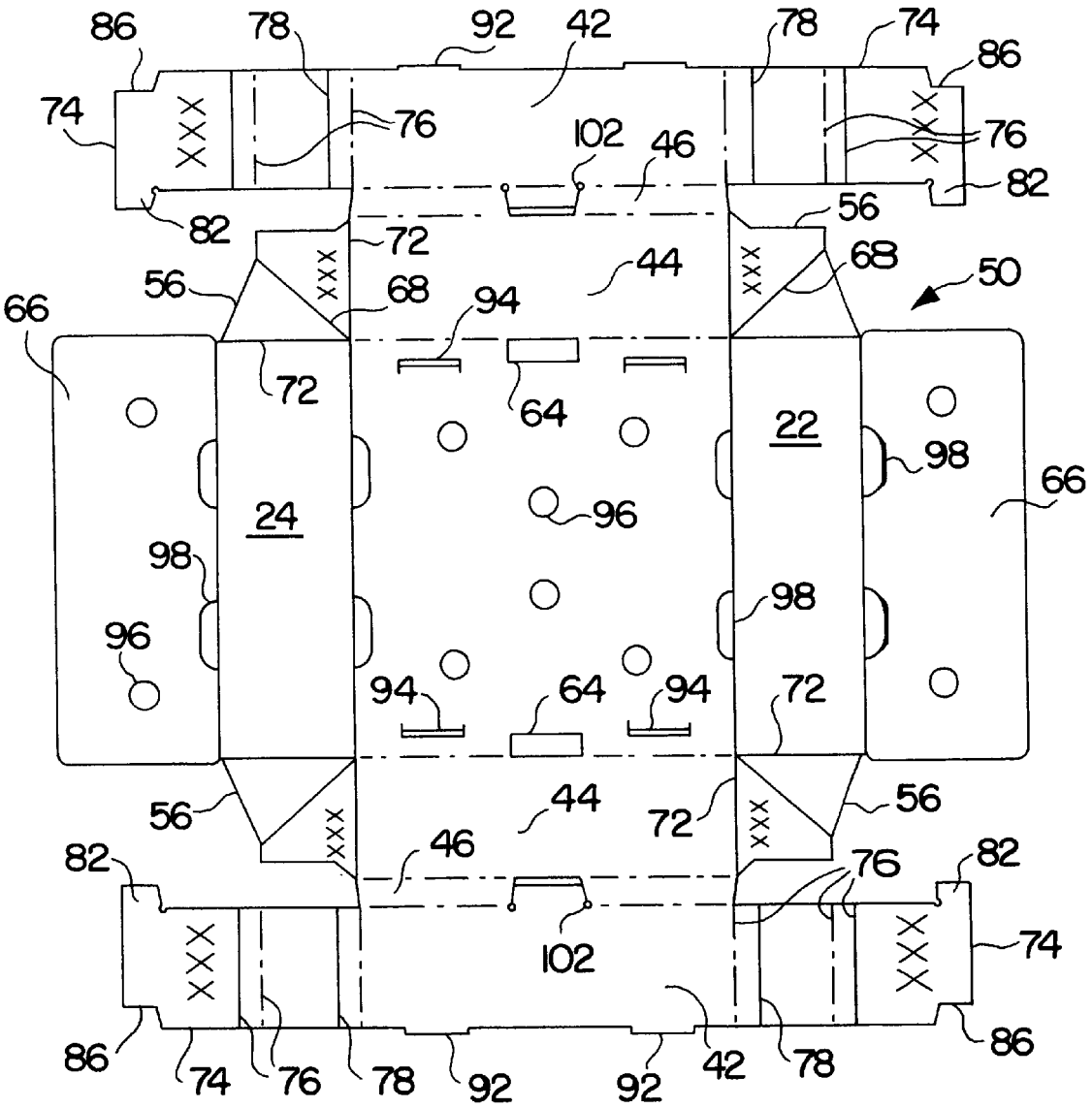
FIG. 2 is a plan view of an integral flat blank to be folded and glued, and erected to provide the container shown in FIG. 1.

FIG. 2 shows the panels of the container blank 50, laid flat, i.e., in the form in which the container is cut as an Integral blank from a sheet of flat corrugated board, paperboard or other sheet material. A number of thicknesses can be die cut in a single step; however the blanks 50 preferably are cut out individually so that the blank can be scored or compressed along the lines that are to be folded, at the same time that the perimeter of the blank is cut from the sheet. Along certain lines the blank is folded when it is made into the collapsed state for shipment, and other lines are folded or partially unfolded when the collapsed blank is erected for packing. Lines representing fold lines are shown in the drawings by broken lines, and can be made by compressing the material along a line, cutting all or part way through the material at spaced intervals, cutting through part of the material thickness, etc.

Blank 50 as shown in plan view generally comprises a one piece bottom panel 28 from which the front and rear 22, 24, and the opposite end walls 26 radiate in mutually perpendicular directions along bottom-to-side wall score lines 32 that will become ninety degree folds. Immediately adjacent to bottom 28 are the side walls that will be folded ninety degrees upwardly from the bottom (normally vertically upright), namely the front and back side wall panels 22, 24 and the outer panels 44 of the end walls 26. The "outer" panels 44 of the end walls 26 are relatively nearer to the bottom panel 28 than the "inner" end wall panels 42, but are termed the outer end wall panels because they define the outside end surface of container 20 when the container has been erected (and vice versa for the inner end wall panels).

Attached by fold lines to the front 22 and back 24 side wall panels, on the opposite side from bottom 28, are the top or lid flaps 66. Opposite from bottom 28 and attached by fold lines between the inner end wall panels 42 and outer end wall panels 44 are the ledge panels 46.

The outer end wall panels 44 and the front/back panels 22. 24 are attached to one another by bellows or gusset fold joints 56, namely tab-like structures extending between the respective panels at the corners of container and having a diagonal fold line 68. The bellows joints 56 permit the respective panels, which are joined to the bottom on perpendicular fold lines 72, to be folded flat against one of two adjacent perpendicular side wall panels and glued there. The other member of joint 56 across the diagonal fold line is attached to the other of the adjacent perpendicular side wall panels but is not glued and can fold relative to its attached side wall panel and/or relative to the other member of joint 56 across the diagonal fold. The portions of the bellows joints to which glue is applied are shown in the FIG. 2 by "XXX" patterns In FIGS. 3 and 4, which illustrate fold-and-glue steps in obtaining KDF blank 52 from flat blank 50, exposed glue areas are likewise shown in "XXX" patterns. Covered areas containing glue on a rear face of a respective panel are shown in broken line "XXX" patterns.

The bellows joints affix the front and back side walls to the outer end wail panels in the collapsed or KDF state of the blank. In the collapsed state the bellows joint panels are laid flat against one of the adjacent perpendicular panels and the other adjacent perpendicular panel is folded over the first (for example in FIG. 4, rear panel 24 is folded over towards outer end wall panels 44) For erecting the container, the panels are raised from parallel to ninety degrees relative to the bottom. For example In FIG. 4, rear panel 44 is rotated toward the right and the lower end wall is rotated upwardly. The panels of the bellows joint pull their connected panel and one another up to ninety degrees relative to the bottom, and in so doing the bellows joint is folded on its diagonal fold line to rest in a folded condition against the panel to which one of the bellows joint panel was glued.

The inner end wall panels 42 are reinforced by the column-forming panels 74 or wings that extend laterally outwardly from the inner end wall panels 42 in flat blank 50. The column-forming panels 74 are folded laterally inwardly in the KDF configuration and are glued to the inner end wall panels 42 at areas shown by "XXX" patterns in the drawings. Column-forming panels 74 are scored or folded at four parallel spaced locations 76 that will correspond to the corners of the hollow columns 55 after erection of container 20. Initially in the KDF configuration, the column-forming panels 74 are not folded along the score line that is parallel to the fold 32 between the bottom and the front or back panels 22, 24. Instead, the column-forming panels 74 are folded at an outermost score line 78 that is located laterally outward from the bottom/front or bottom/rear fold line 32 by a distance equal to the width of ledge panel 46 and the space between the inner and outer end wall panels 42, 44. The column forming panels 74 are dimensioned so that as folded laterally inwardly, their extreme ends 82 substantially meet at the longitudinal center line of container 20 (i.e., at the center of an end wall 26). At their ends 82 each column-forming panel 74 has an upward extension 84 that forms part of a protruding registration tab on one side. On the opposite side the column-forming panel has an indentation 86 complementary with tab extension 84. In conjunction with a registration tab opening 64 in the bottom of the container, the indentation 86 provides clearance space for the registration tab of a similar container (not shown) on which container 20 may be stacked.

Figure 3:
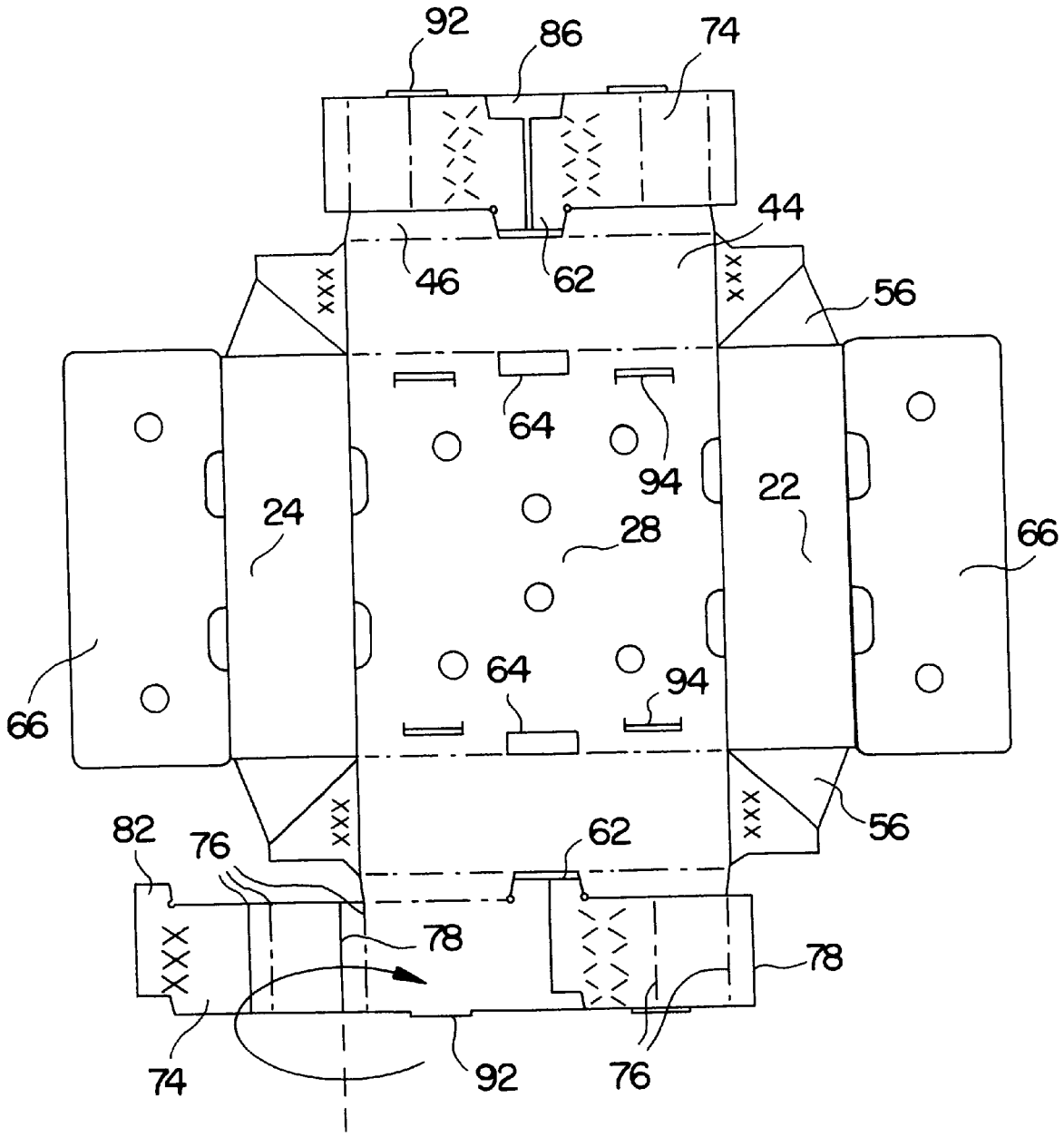
FIG. 3 is a plan view of the blank of FIG. 2, showing the gluing and folding operations associated with the hollow columns to be opened in erecting the end wall.
Figure 4:
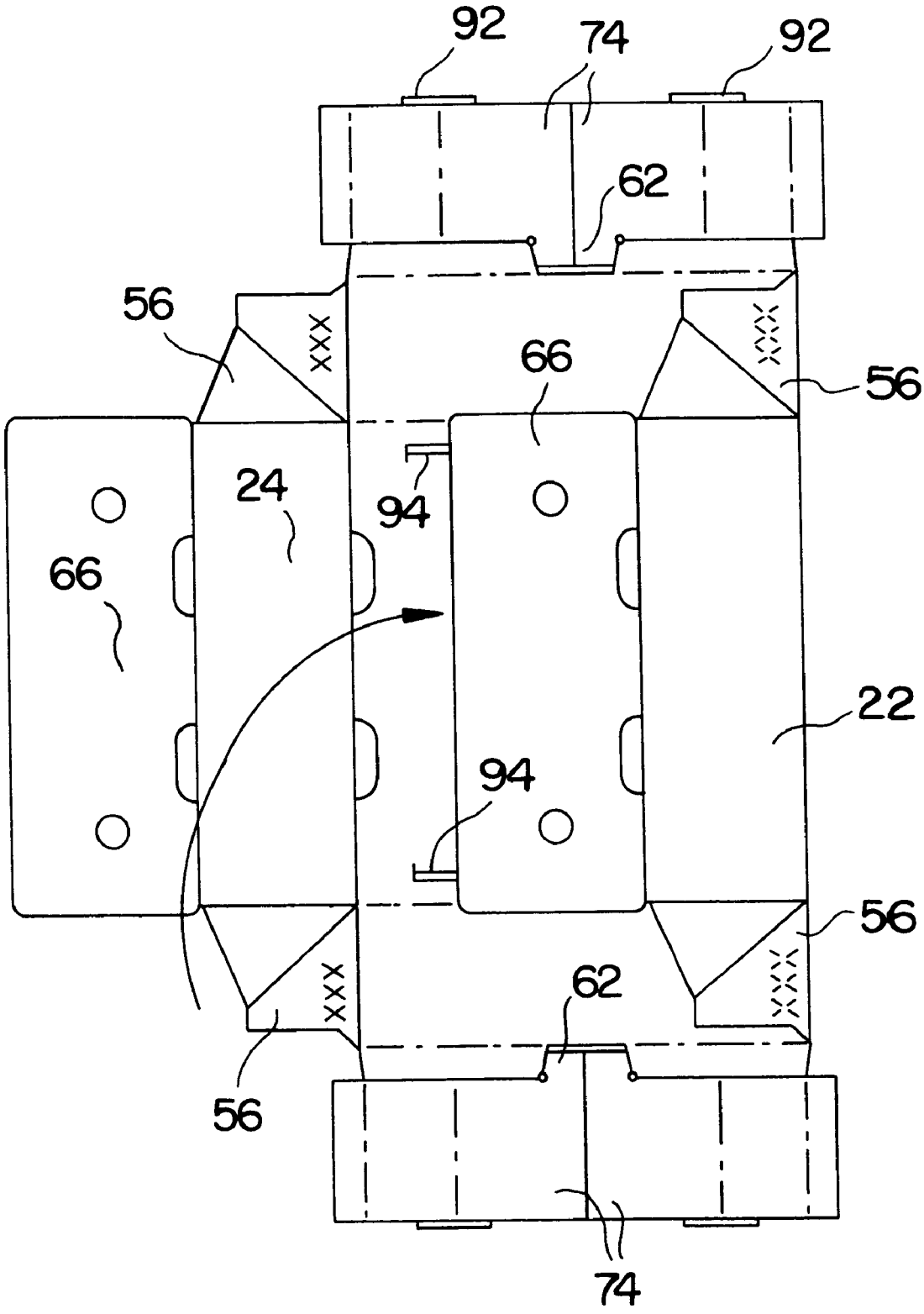
FIG. 4 is a plan view of the blank of FIG. 3, showing the gluing and folding operations associated with the bellows corners.

FIG. 3 shows the gluing and folding operation associated with affixing the column-forming panels 74 to the surface of the inner end wall panel 42, including folding panels 74 inwardly. FIG. 4 illustrates the step of gluing the bellows corners 56 to the inner end wall 42, including folding front and rear panels 22, 24 over bottom 28. FIG. 4 also generally shows the appearance of the KDF configuration of the blank. In the KDF configuration the blank is compact in that the internal volume of the container is substantially completely collapsed. The KDF blanks can be stacked and bound for shipment to a packer who erects the containers prior to packing them with product. Inasmuch as erection of the container is a simple operation, the same worker who loads the containers can easily erect them immediately prior to packing.

Figure 5:
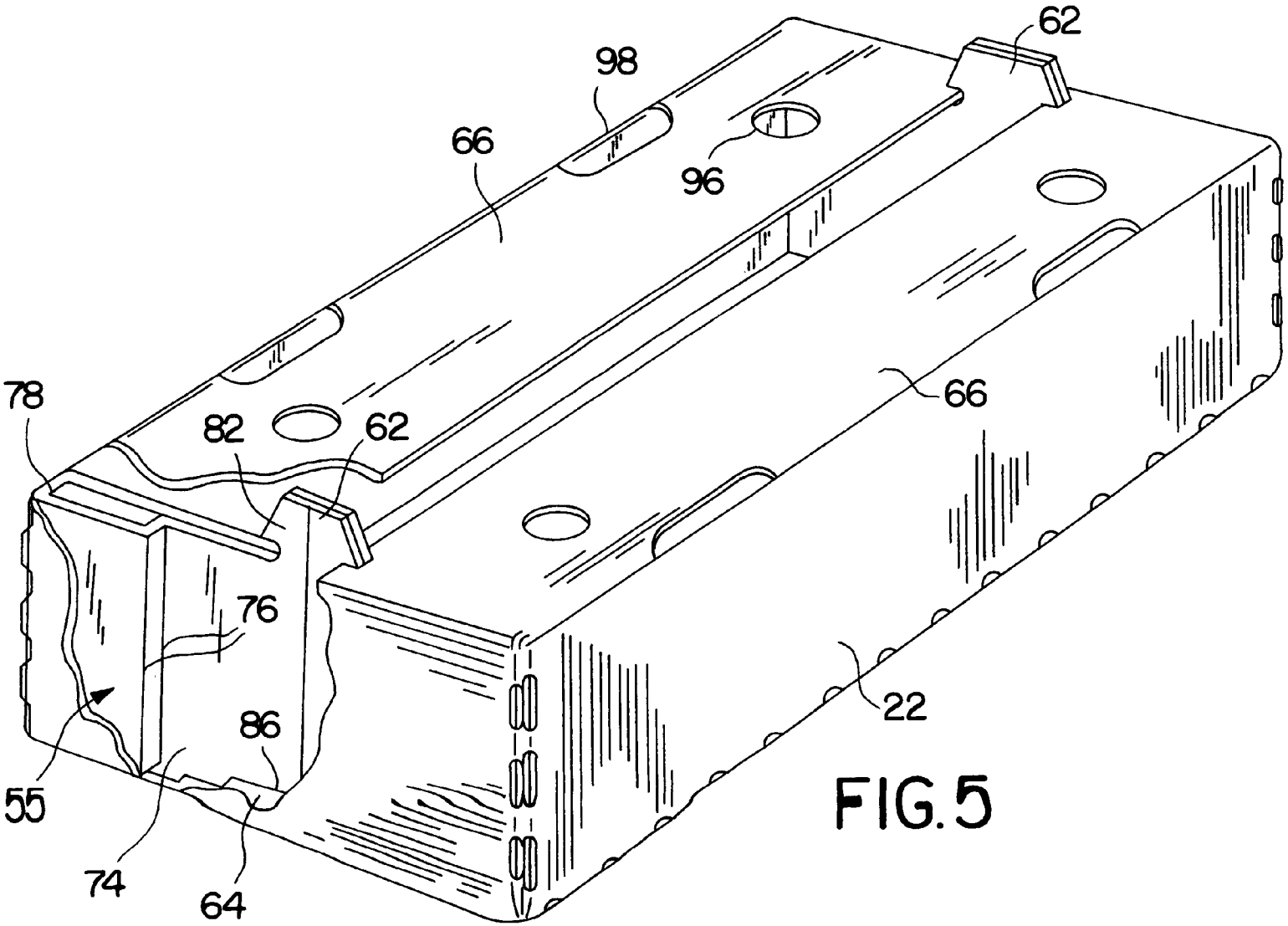
FIG. 5 is a perspective view of the container corresponding to FIG. 1, shown with the outer end wall panel partly cut away to illustrate the internal hollow column formed in the erected state between the inner and outer end wall panels.
Figure 6:
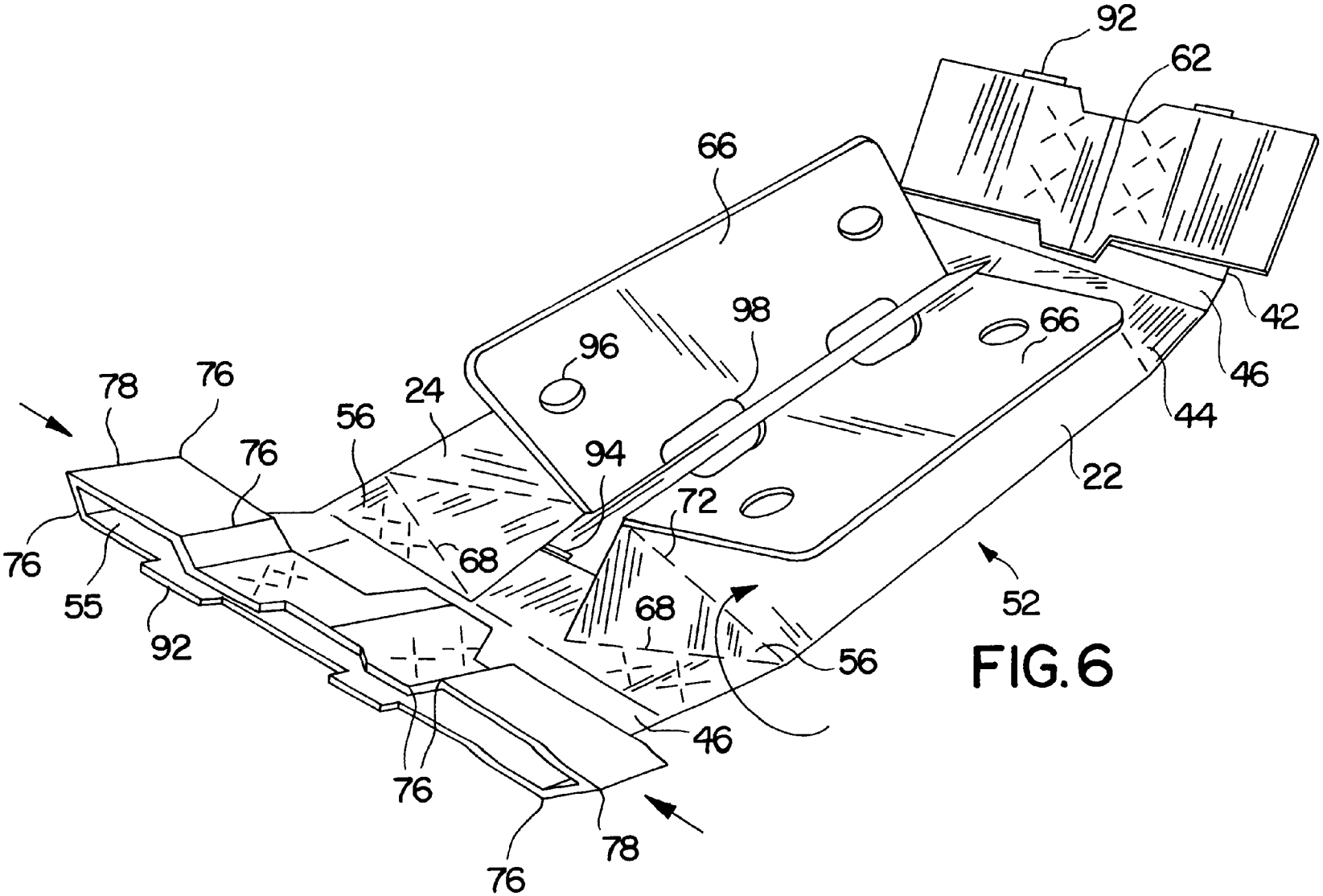
FIG. 6 is a perspective view illustrating an aspect of erecting the container, namely exerting inward lateral force on the column-forming panels to open the hollow panels during folding of the inner end wall panel into the space between the front and back to lock via tabs in the container bottom, as shown in the drawing by arrows.

Container is erected from the KDF state shown in FIG. 4 to the erected state shown in FIG. 5, wherein the hollow columns 55 are opened from flattened parallelogram shapes and fit into the space between the front and back 22, 24 and between the inner and outer end wall panels 42, 44. Specifically, erection is accomplished as shown in FIG. 6 The end wall panels 42, 44 are raised and folded inwardly over and toward bottom 28 until locking tabs 92 extending longitudinally from inner end wall panels 42 lock Into the locking tab openings 94 provided in bottom 28 of the container. More particularly, a ninety degree fold is made between bottom 28 and outer end wall panel 44, thereby raising front and rear panels 22, 24 from bottom 28 due to the action of bellows joint 56. Alternatively the front and rear panels 22, 24 can be raised, simultaneously raising outer end wall panel 44 due to the bellows joint (i.e., either the front/rear or end wall panel can be raised and will pull up the other).

A ninety degree fold is then made between ledge panel 46 and inner and outer end wall panels 42, 44, respectively. This causes inner end wall panel 42 to fold over and be directed downwardly toward bottom 28 of container 20, where looking tabs 92 fit into their receptacles 94, for example narrow slots with adjacent cuts permitting deflection of bottom adjacent the slots to admit the locking tabs.

According to an inventive aspect, the column-forming panels 74 are not folded in the KDF state along a line parallel to the fold 32 between the bottom 28 and the front or back 22, 24. As a result the column-forming panel 74 protrudes laterally on both sides to its outermost fold 78, beyond the space provided between the opposite front and back walls 22, 24. This aspect is illustrated in FIG. 6. In order to fit inner end wall panel 42 and the column-forming panel glued thereto between front and back 22, 24, the worker presses the protruding ends of the hollow columns 55, namely folds 78, laterally inwardly while rotating the inner end wall panel 42 downwardly to engage the locking tabs 92 in their receptacles 94. The hollow columns 55 are thereby opened from flattened parallelograms into the rectilinear cross section shown In FIG. 5. As the inner end wall panel 42 enters the space between the front and back 22, 24, lateral inward pressure is exerted on hollow columns 55 by the front and back walls 22, 24. The result Is a snug fit that further stiffens and strengthens container 20.

The exemplary blank shown in the drawings has a number of additional openings 96. 98 in the bottom and in the top or lid panels. These openings are optional but are appropriate, for example, for a container used as an agricultural shipping container for produce or the like. The round openings 96 shown in the central areas of bottom 28 and top panels 66 provide for advantageous air circulation. The approximately oval openings 98 at the junctions of the top or bottom and the side walls also provide for air circulation and have the further benefit of usefulness for hand or finger holds.

Accordingly, according to the invention a container 20 is provided comprising a plurality of panels defining a bottom 28, a laterally opposite front wall 22 and a back wall 24, and longitudinally opposite end walls 26. The end walls 26 have an outer end wall panel 44 joined to the bottom 28, a ledge panel 46 joined to the outer end wall panel 44, and an inner end wall 42 panel joined to the ledge panel 46. At least one column-forming panel 74 is joined to one of the inner and outer end wall panels 42, 44. The column-forming panel 74 is folded laterally inwardly and expands to form a hollow column 55 supporting the ledge panel 46 in the erected state of container 20. As described, two column-forming panels 74 are provided on each inner end wall panel 42 and are arranged symmetrically, each opening into a hollow column 55 that is disposed at the corner of container 20 between the inner and outer end wall panels 42, 44, i.e., under ledge panel 46. All the panels preferably are integrally connected parts of a single flat blank 50 that further includes inwardly folded bellows panels extending between the end walls 26 and the front and back 22, 24. The bellows panels connect the end walls 26 with the front and the back. During erection from a knocked-down-flat configuration the bellows panels draw the front and the back 22, 24 perpendicular to bottom 28. Specifically, as the end walls are moved perpendicular to the bottom they pull up the front and back side walls, and vice versa. The bellows panels each have two parts that are joined at a fold 68 oriented substantially diagonally relative to the adjacent end wall 26 and front or back 22, 24. One of these two parts is attached to the adjacent one of the end walls, front or back, preferably to the inner face of the outer end all panel 44.

The column-forming panel 74 extends laterally beyond the inner end wall panel 42. The column-forming panel 74 is folded laterally inwardly along an outermost fold line 78 that is spaced laterally outwardly from the fold line 32 joining the bottom 28 to the front or back 22, 24, and is glued to the inner end wall panel 42 elusively at a space from the fold lines of the column-forming panel, leaving the column-forming panel free to expand from a flattened parallelogram into a rectilinear cross section. The erected hollow column bears resiliently against the inside surface of the front or back 22, 24, which holds the column 55 open and contributes to the stiffness and structural support of the container as a whole.

The column-forming panel 74 has four score or fold lines 76, 78 located at the corners of each hollow column 55, which is rectangular in cross section and fits in the space between the inner and outer end wall panels 42, 44. In the embodiment With symmetrical column-forming panels folded inwardly from opposite lateral sides, each of the column forming panels has half of a protruding registration tab 62 at its end glued to the inner end wall panel 42. Each inner end wall panel has locking tabs 92 oriented longitudinally. The locking tabs 92 engage in locking tab receptacles 94 in container bottom 28, when the inner end wall panel 42 is folded into the space between the front and back 22, 24.

The registration tab portions 84 of the column-forming panels 74 are preferably backed by a registration tab portion of the outer end wall panel 44, forming a registration tab 62 of two thicknesses. This two thickness registration tab is spaced longitudinally inwardly from the outer end wall panel 44 and is located against the inner end wall panel 42 at the inner edge of ledge 46, rather than at the extreme longitudinal end of container 20. The protruding part cut from ledge 46 is coplanar with the inner end wall panel 42 and is backed by the protruding part 84 of the column-forming panel 74. These protruding parts together form the registration tab 62. The registration tab extends upwardly from ledge 46 by a distance greater than the thickness of the top or lid panels 66.

The protruding parts of the inner end wall panel and the column-forming panel are positioned in registry with a registration opening 102 in the bottom of container 20 such that the container is stackable in registry with similar containers by insertion of registration tab 66 into the registration opening 102. The column-forming panel has an indentation 86 opposite from and complementary with Its protruding registration tab portion. The inner column-forming panel can have an indentation corresponding to its protrusion as well, whereby the registration tab of a container fits exactly into the registration opening of a container stacked thereon. However, the inner column-forming panel also can be arranged without such an indentation. In that case, the registration tab of a container is resiliently deflected longitudinally outwardly around the inner end wall panel and the column-forming panel of the upper container. The registration opening is sufficiently wide to accommodate this deflection (i.e., the opening is double the width of the tab in the longitudinal direction). This structure is such that the registration tab locks securely in the registration opening of the next upper stacked container, and together with the column-forming panel of the upper container occupies most or all of the space between the inner and outer end wall panels of the upper container.

The registration tab has a stepped edge on each lateral side, being shaped as a barb or arrowhead that engages with the edge of the top flap when the top flap is folded down. The top panel, which is attached to one of the front and the back at a fold line, is foldable laterally inwardly to define a lid on the container and snaps over the barb of the protrusion to lock the container closed without the need for any glue, staples, tape or the like.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A container comprising:

a plurality of panels defining a bottom, a laterally opposite front wall and a back wall, and longitudinally opposite end walls, the end walls having an outer end wall panel joined to the bottom, a ledge panel joined to the outer end wall panel, and an inner end wall panel joined to the ledge panel, at least one column-forming panel being joined to one of the inner and outer end wall panels, the column-forming panel being folded laterally inwardly and being expandable to form a hollow column supporting the ledge panel in the erected state of the container.

2. The container of claim 1, wherein the bottom, front wall, back wall, inner end wall panel, ledge panel, outer end wall panel and column-forming panel are cut from an integral flat sheet.

3. The container of claim 1, wherein two said column-forming panels are provided on an inner end wall panel at each longitudinal end of the container.

4. The container of claim 1, further comprising inwardly folded bellows panels extending between the end walls and the front and the back and connecting the front and the back to the end walls such that when one of the front, the back and the end walls is pulled upwardly, said one pulls another from a knocked-down-flat configuration to an orientation perpendicular to the bottom.

5. The container of claim 4, wherein the bellows panels each have two parts joined at a fold oriented substantially diagonally relative to an adjacent end wall and one of the front or back, one of said two parts being attached to one of said adjacent end wall, front and back.

6. The container of claim 1, wherein the column-forming panel extends laterally beyond the inner end wall panel and is folded laterally inwardly along a fold line spaced laterally outwardly from a fold line joining the bottom to one of the front and the back, the column-forming panel being attached to the inner end wall panel exclusively at a space from said fold line of the column-forming panel, and the hollow column bearing against an inside surface of one of the front and the back in an erected state of the container.

7. The container of claim 1, wherein two column-forming panels are symmetrically folded laterally inwardly from opposite sides of each inner end wall panel, each of the column forming panels comprising part of a protruding registration tab at an end glued to the inner end wall panel.

8. The container of claim 7, wherein each inner end wall panel has a locking tab extending longitudinally of the container, the locking tab engaging in a corresponding locking tab receptacle in the bottom of the container when the inner end wall panel is folded into a space between the front and back.

9. The container of claim 8, wherein a registration tab is cut from the ledge panel and is aligned with said protrusion such that the protrusion and the registration tab cut from the ledge panel form a plural thickness stacking tab aligned to said opening in the bottom of the container.

10. The container of claim 9, comprising two opposite said column forming panels one each said inner wall panel, the opposite column forming panels each comprising a protrusion, the plural thickness stacking tab comprising the registration tab cut from the ledge panel and said protrusions of said opposite column forming panels.

11. The container of claim 1, wherein the column-forming panel comprises a plurality of score and fold lines spaced to define corners of the hollow column.

12. The container of claim 11, wherein a laterally innermost one of said score and fold lines Is substantially parallel to a fold line between the bottom of the container and one of said front and said back, whereby said one of the front and the back limits a position of the hollow column in an erected state of the container, thereby holding open the hollow column.

13. The container of claim 8, further comprising a top panel attached to one of the front and the back, the top panel being foldable laterally inwardly to define a lid on the container.

14. The container of claim 13, comprising opposite said top panels attached to each of the front and the back, and wherein the opposite top panels are structured to engage with the registration tab for holding the lid closed.

15. The container of claim 14, wherein the opposite top panels are dimensioned to engage against opposite edges of the registration tab.

16. The container of claim 15, wherein the registration tab has a stepped edge on said opposite edges and the top panels are dimensioned to pass the stepped edge, whereby the registration tab forms a barb holding the opposite top panels closed.

17. The container of claim 1, wherein the inner end wall panel comprises locking tabs engageable with corresponding locking tab openings in the bottom.

18. A container comprising:

a plurality of corrugated paperboard panels defining a bottom, a laterally opposite front wall and a back wall having top panel flaps, and longitudinally opposite end walls, said panels being integral parts of a single piece of flat stock;

wherein the bottom is attached to the front wall and to the back wall by inwardly folded bellows panels, each having a fold oriented substantially diagonally relative to an adjacent one of the end walls and the front and back and being glued to said adjacent one of the end walls, whereby the bellows panels and the end walls pull one another perpendicular to the bottom when erected;

wherein the end walls comprise an outer end wall panel joined at a fold to a ledge panel, and an inner end wall panel joined at a fold to the ledge panel;

each of the inner end wall panels being joined at a plurality of score and fold lines to laterally opposite column-forming panels, the column forming panels being folded inwardly and glued to a face of the inner end wall panel at a space from the fold and score lines such that the column-forming panels and their respective inner end wall panel are openable into a hollow column, the fold and score lines being placed to define corners of the hollow column and a laterally innermost one of said score and fold lines being substantially parallel to a fold line between the bottom of the container and one of said front and said back, whereby said one of the front and the back limits a position of the hollow column in an erected state of the container, thereby holding open the hollow column.

19. The container of claim 18, wherein the end walls each comprise a registration tab extending upwardly from the ledge panel and the bottom has a registration tab opening aligned with the registration tab whereby the container is stackable in registry with another similar container.

20. The container of claim 19, wherein the registration tab comprises one thickness cut from the ledge panel and a second thickness provided by a protrusion of the column-forming panel.

21. The container of claim 20, wherein the registration tab has laterally opposite stepped edges dimensioned such that edges of the top panel flaps pass and are locked down by the stepped edges when the top panel flaps are folded downwardly to engage the registration tab.

* * * * *